US008579432B2

(12) United States Patent
Sakano

(10) Patent No.: US 8,579,432 B2
(45) Date of Patent: Nov. 12, 2013

(54) RECORDING APPARATUS WITH REMOVABLE MEMBER

(75) Inventor: Yuji Sakano, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 227 days.

(21) Appl. No.: 13/076,551

(22) Filed: Mar. 31, 2011

(65) Prior Publication Data

US 2012/0081486 A1 Apr. 5, 2012

(30) Foreign Application Priority Data

Sep. 30, 2010 (JP) ..... 2010-221030

(51) Int. Cl.
*B41J 2/01* (2006.01)

(52) U.S. Cl.
USPC ..... 347/104; 347/101; 400/624

(58) Field of Classification Search
USPC ..... 347/104, 108, 109, 152, 153, 215, 222, 347/262, 263, 264, 101; 271/118, 3.14; 399/388, 393; 400/624, 625
IPC ..... B41J 2/01
See application file for complete search history.

(56) References Cited

U.S. PATENT DOCUMENTS 5,435,537 A * 7/1995 Gysling ..... 271/10.05
8,132,809 B2 3/2012 Shiraishi et al.
2002/0024578 A1* 2/2002 Yamashita ..... 347/108
2005/0179192 A1* 8/2005 Miura et al. ..... 271/118
2006/0140694 A1* 6/2006 Yano ..... 399/393
2007/0147919 A1* 6/2007 Lim ..... 399/388
2008/0001342 A1* 1/2008 Matsushima et al. ..... 271/3.14
2008/0251991 A1* 10/2008 Doyo ..... 271/109
2008/0265488 A1* 10/2008 Hiura et al. ..... 271/110
2009/0141111 A1* 6/2009 Yamamoto ..... 347/104
2010/0133739 A1 6/2010 Shiraishi et al.

FOREIGN PATENT DOCUMENTS

JP 05-124741 5/1993
JP 2006-315832 11/2006
JP 2010-126327 6/2010

OTHER PUBLICATIONS

Decision to Grant for the corresponding Japanese Patent Application No. 2010-221030 dtd. Jun. 12, 2012.

* cited by examiner

*Primary Examiner* — Manish S Shah
*Assistant Examiner* — Roger W Pisha, II
(74) *Attorney, Agent, or Firm* — Banner & Witcoff, Ltd.

(57) ABSTRACT

A recording apparatus including: a casing provided with a feed roller for feeding a recording medium; a removable member insertable into and removable from the casing by being moved relative to the casing in an axial direction of the feed roller wherein on the removable member is mounted a nip roller via a shaft thereof extending in parallel with the axial direction of the feed roller, the nip roller; a force applying portion which applies a force to the nip roller in a direction in which the nip roller is moved toward the feed roller; and a moving mechanism which moves the nip roller against the force in a mounting and removing operation in a direction in which the nip roller is moved away from the feed roller.

8 Claims, 7 Drawing Sheets

RECORDING APPARATUS WITH REMOVABLE MEMBER

CROSS REFERENCE TO RELATED APPLICATION

The present application claims priority from Japanese Patent Application No. 2010-221030, which was filed on Sep. 30, 2010, the disclosure of which is herein incorporated by reference in its entirety.

BACKGROUND OF THE INVENTION

1. Field of the Invention

The present invention relates to a recording apparatus configured to record an image onto a recording medium.

2. Description of the Related Art

There is conventionally known a recording apparatus in which a removable member (such as a tray) accommodating a recording medium is removably provided on a casing on which is mounted a feeding roller for feeding the recording medium. In a conventional technique, a sheet-supply tray (as a removable member) is mountable on and removable from a copier main body (a casing). On the sheet-supply tray is mounted a friction roller (as a nip roller) which is contactable with a feed roller mounted on the copier main body.

In this technique, the friction roller is movable upward and downward. The friction roller is located at an upper position at which the friction roller contacts the feed roller, in a state in which the sheet-supply tray is mounted on the main body, and the friction roller is located at a lower position in a state in which the sheet-supply tray has been removed from the main body.

SUMMARY OF THE INVENTION

As in the conventional technique, where the nip roller is located at the lower position in the state in which the removable member has been removed from the casing, it is difficult for a user to replace the nip roller with new one.

This invention has been developed in view of the above-described situations, and it is an object of the present invention to provide a recording apparatus in which it is relatively easy for a user to replace a nip roller with, new one.

The object indicated above may be achieved according to the present invention which provides a recording apparatus, comprising: a casing on which is mounted a feed roller rotatable to feed a recording medium; a removable member insertable into and removable from the casing by being moved relative to the casing in an axial direction of the feed roller, between (a) a removable-member mounted state in which the removable member is mounted on the casing and (b) a removable-member removed state in which the removable member has been removed from the casing, wherein on the removable member is mounted a nip roller via a shaft thereof extending in parallel with the axial direction of the feed roller, the nip roller being configured to nip the recording medium with the feed roller in the feeding of the recording medium in the state in which the removable member is in the removable-member mounted state; a force applying portion configured to apply a force to the nip roller in a direction in which the nip roller is moved toward the feed roller; and a moving mechanism configured to move the nip roller against the force of the force applying portion in a mounting and removing operation in a direction in which the nip roller is moved away from the feed roller when seen in a direction in which the removable member is moved, wherein the mounting and removing operation is an operation in which the removable member is moving between a position corresponding to the removable-member mounted state and a position corresponding to the removable-member removed state.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENT

Hereinafter, there will be described an embodiment of the present invention by reference to the drawings.

Figure 1:
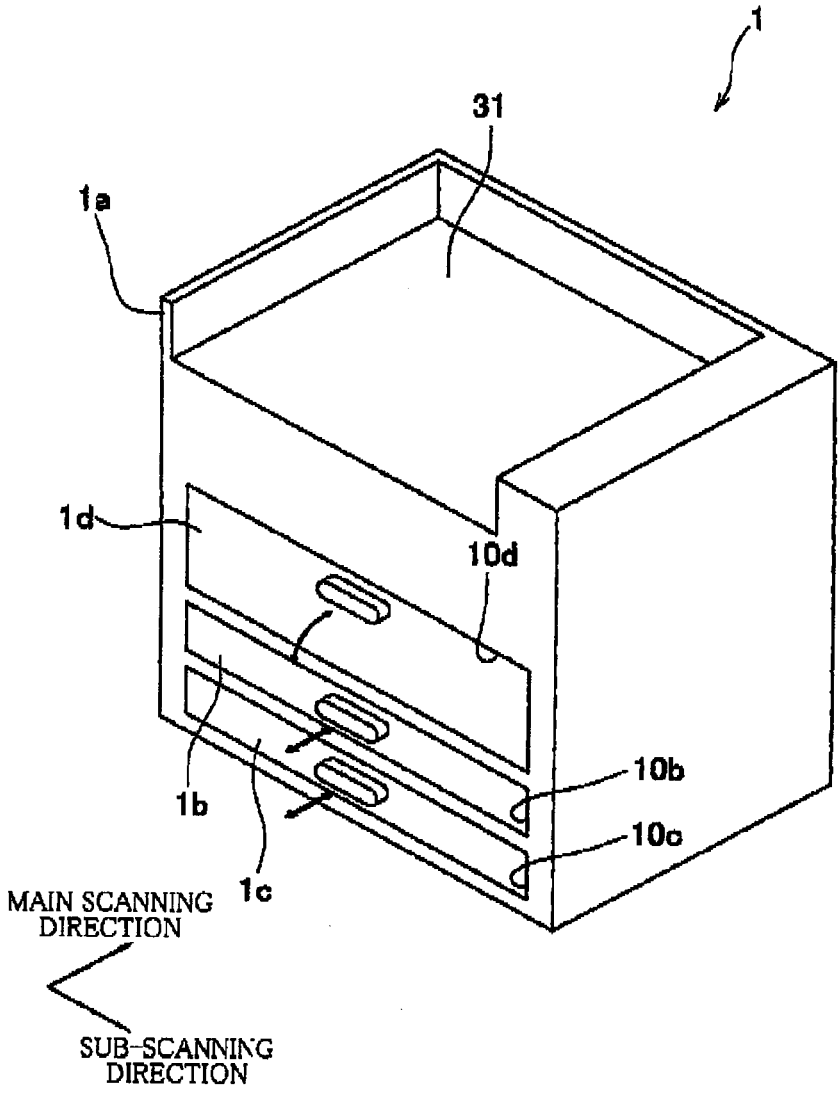
FIG. 1 is an external perspective view of an ink-jet printer as an embodiment of the present invention.

There will be explained an overall construction of an ink-jet printer 1 as one example of a recording apparatus to which the present invention is applied, with reference to FIG. 1.

The printer 1 includes a casing 1*a* having a rectangular parallelepiped shape. A sheet-discharge portion 31 is provided on a top plate of the casing 1*a*. In a front face of the casing 1*a* (i.e., a front left face thereof in FIG. 1), three openings 10*d*, 10*b*, 10*c* are formed in order from an upper side thereof. The opening 10*b* is an opening through which a sheet-supply unit 1*b* (as one example of a removable member) is inserted into the casing 1*a*, and the opening 10*c* is an opening through which an ink unit 1*c* is inserted into the casing 1*a*. A door 1*d* having a horizontal shaft at a lower end thereof is fitted in the opening 10*d* so as to be opened and closed with the horizontal shaft as a support point. The door 1*d* is disposed so as to be opposed to a sheet-feed unit 21 (see FIG. 2) in a main scanning direction in the casing 1*a* (i.e., a direction perpendicular to the front face of the casing 1*a*).

Figure 2:
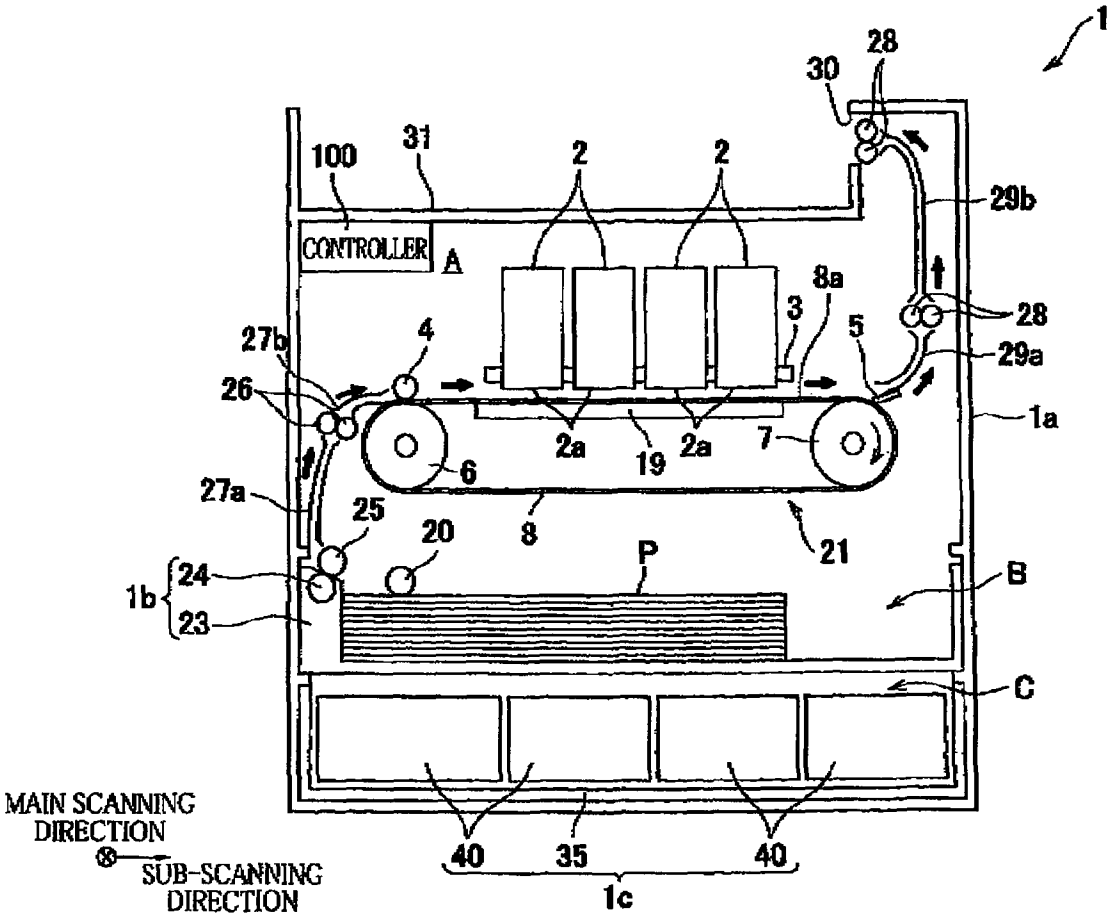
FIG. 2 is a side view generally showing an, internal structure of the printer.

There will be next explained an internal structure of the printer 1 with reference to FIG. 2.

An inner space of the casing 1*a* is divided into spaces A, B, C in order from an upper side thereof. In the space A, there are disposed (a) four ink-jet heads 2 configured to respectively eject inks of four colors, namely, magenta, cyan, yellow, and black, (b) the sheet-feed unit 21 configured to feed a recording medium such as a sheet P, and (c) a controller 100 configured to control operations of the printer 1. The sheet-supply unit 1*b* is disposed in the space B, and the ink unit 1*c* is disposed in the space C. In the printer 1, there is formed a sheet feeding path through which the sheet P is fed or conveyed from the sheet-supply unit 1*b* toward the sheet-discharge portion 31 along bold arrow shown in FIG. 2.

The controller 100 includes a Central Processing Unit (CPU), a Read Only Memory (ROM), a Random Access Memory (RAM) such as a nonvolatile RAM, an Interface (I/F), and so on. The ROM stores therein programs executed by the CPU, various fixed data, and so on. The RAM temporarily stores therein data (such as image data) required for the execution of the programs. The controller 100 communicates with an external device (such as a personal computer (PC) connected to the printer 1) via the I/F. For example, the controller transmits and receives the data to and from the external device via the I/F.

The sheet-supply unit 1*b* includes a tray 23 as one example of accommodating portion and a nip roller 24 and is insertable into and removable from the casing 1*a* in the main scanning direction. The tray 23 is formed by a box opening upward so as to accommodate sheets P of various sizes. The nip roller 24 is rotated by the control of the controller 100 to feed the sheet P to the sheet-feed unit 21 while nipping the sheet P with a sheet-feed roller 25 which will be described below. In the present embodiment, the nip roller 24 is a retard roller having a function for preventing a plurality of the sheets P from being fed at a time by the nip roller 24 and the sheet-feed roller 25. That is, the nip roller 24 includes a torque limiter. Where the nip roller 24 has nipped a single sheet P with the sheet-feed roller 25, the nip roller 24 is rotated forwardly (i.e., in a counter clockwise direction in FIG. 2). Where the nip roller 24 has nipped a plurality of the sheets P with the sheet-feed roller 25, the nip roller 24 is rotated reversely (i.e., in a clockwise direction in FIG. 2).

In the space B, there are provided a pick-up roller 20 and the sheet-feed roller 25 in addition to the sheet-supply unit 1*b*. The pick-up roller 20 is always held in contact with an uppermost one of the sheets P accommodated in the tray 23, and is rotated by the controller 100 to supply the sheet P. The sheet-feed roller 25 is for feeding the sheet P while nipping the sheet P with the nip roller 24. Each roller 20, 25 extends in the main scanning direction and is mounted on the casing 1*a*. As shown in FIG. 2, the nip roller 24 extends in parallel with the rollers 20, 25 in a sub-scanning direction in a state (position) in which the sheet-supply unit 1*b* is mounted on the casing 1*a* (hereinafter may be referred to as a "supply-unit mounted state"). That is, the sheet-supply unit 1*b* is mounted on the casing 1*a* such that a shaft of the nip roller 24 extends in parallel with the rollers 20, 25.

The sheet P fed by the rollers 24, 25 is fed to the sheet-feed unit 21 by being guided by guides 27*a*, 27*b* and being nipped by a feed-roller pair 26.

The sheet-feed unit 21 includes (a) belt rollers 6, 7, (b) an endless sheet feeding belt 8 wound around the rollers 6, 7, (c) a pressing roller 4 and a peeling plate 5 disposed on opposite sides (outsides) of the sheet feeding belt 8 in the sub-scanning direction, (d) a platen 19 disposed inside the sheet feeding belt 8, and so on.

The belt roller 7 is a drive roller which is controlled by the controller 100 so as to be rotated in the clockwise direction in FIG. 2. The sheet feeding belt 8 runs or is circulated along the bold arrow in FIG. 2 in accordance with the rotation of the belt roller 7. The belt roller 6 is a driven roller which is rotated in the clockwise direction in FIG. 2 in accordance with the circulation of the sheet feeding belt 8. The pressing roller 4 is disposed so as to face the belt roller 6 and press, onto an outer circumferential face 8*a* of the sheet feeding belt 8, the sheet P fed from the tray 23 to the sheet-feed unit 21. The peeling plate 5 is disposed so as to face the belt roller 7 and peel the sheet P from the outer circumferential face 8*a* and guide the sheet P to a downstream side thereof in a sheet feeding direction in which the sheet P is fed. The platen 19 is disposed so as to face the four heads 2 with the sheet feeding belt 8 interposed therebetween and so as to support an upper portion of the sheet feeding belt 8 from an inside thereof. As a result, a space suitable for image recording is formed between the outer circumferential face 8*a* and bottom faces 2*a* of the respective heads 2 (i.e., ink-ejection faces in which are formed a multiplicity of ink-ejection openings for ejecting the respective inks).

A silicon layer having a low viscosity is formed on the outer circumferential face 8*a*. The sheet P fed from the tray 23 to the sheet-feed unit 21 is pressed onto the outer circumferential face 8*a* by the pressing roller 4 and then fed in the sub-scanning direction along boldface arrow while being held by and on the outer circumferential face 8*a* owing to the viscosity thereof.

Here, the sub-scanning direction is a direction parallel to the sheet feeding direction in which the sheet P is fed by the sheet-feed unit 21 and along a horizontal plane, and the main scanning direction is a direction perpendicular to the sub-scanning direction and along the horizontal plane.

When the sheet P passes through positions just under the heads 2, the heads 2 are driven by the controller 100 to eject the inks of respective four colors in order from the respective bottom faces 2*a* onto the sheet P, thereby forming a desired color image on the sheet P. Then, the sheet P is peeled off from the outer circumferential face 8*a* by the peeling plate 5, then fed upward by two feed-roller pairs 28 while being guided by guides 29*a*, 29*b*, and finally discharged onto the sheet-discharge portion 31 through an opening 30 formed in an upper portion of the casing 1*a*. One roller of each feed-roller pair 28 is rotated by the controller 100.

Each of the heads 2 is a line head elongated in the main scanning direction (i.e., a direction perpendicular to a sheet face of FIG. 1) and having a generally rectangular parallelepiped shape. The heads 2 are arranged in the sub-scanning direction at predetermined pitches and supported by the casing 1*a* via a frame 3. On an upper face of each head 2 is provided a joint to which a flexible tube is connectable. The bottom face 2*a* of each head 2 has the multiplicity of the ink-ejection openings formed therein. In each head 2, there are formed ink channels in which the corresponding ink supplied from an ink cartridge 40 via the tube and the joint flows to the ink-ejection openings.

The ink unit 1*c* includes a cartridge tray 35 and four ink cartridges 40 arranged side by side in the tray 35. A leftmost one of the cartridges 40 in FIG. 2 stores the black ink and has a larger ink capacity and a larger size in the sub-scanning direction than those of each of the other three cartridges 40. The other three cartridges 40 respectively store the magenta, cyan, yellow inks and have the same ink capacity and the same size in the sub-scanning direction as one another. The ink of each cartridge 40 is supplied to the corresponding head 2 via the corresponding tube and joint.

The tray 35 is insertable into and removable from the casing 1*a* in the main scanning direction in a state in which the cartridges 40 have been mounted on the tray 35. Thus, the user of the printer 1 can selectively replace the cartridges 40 accommodated in the tray 35 in a state in which the tray 35 has been removed from the casing 1*a*.

There will be next explained a structure of the sheet-supply unit 1*b* with reference to FIGS. 3-7B.

Figure 3:
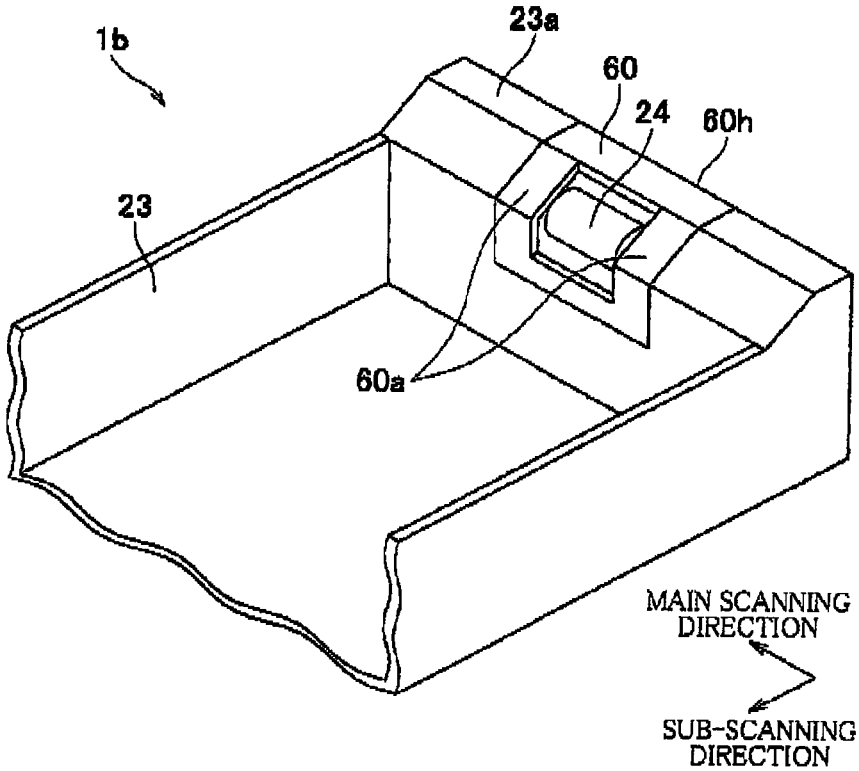
FIG. 3 is an external perspective view showing a sheet-supply unit mountable on and removable from a casing of the printer.

As shown in FIG. 3, the nip roller 24 is mounted on a side face 23*a* of the tray 23. On the side face 23*a* is provided a cover 60 opened and closed by a manual operation of the user so as to be swung on a hinge portion 60*h* extending in the main scanning direction. The cover 60 is movable between (a) a closed position, shown in FIGS. 3, 7A, 7B, and 7C, at which the cover 60 covers components (i.e., an area) near the nip roller 24 (including a shaft 24*x* which will be described below) and (b) an open position shown in FIG. 7D at which the components (i.e., the area) near the nip roller 24 are exposed.

Figure 4:
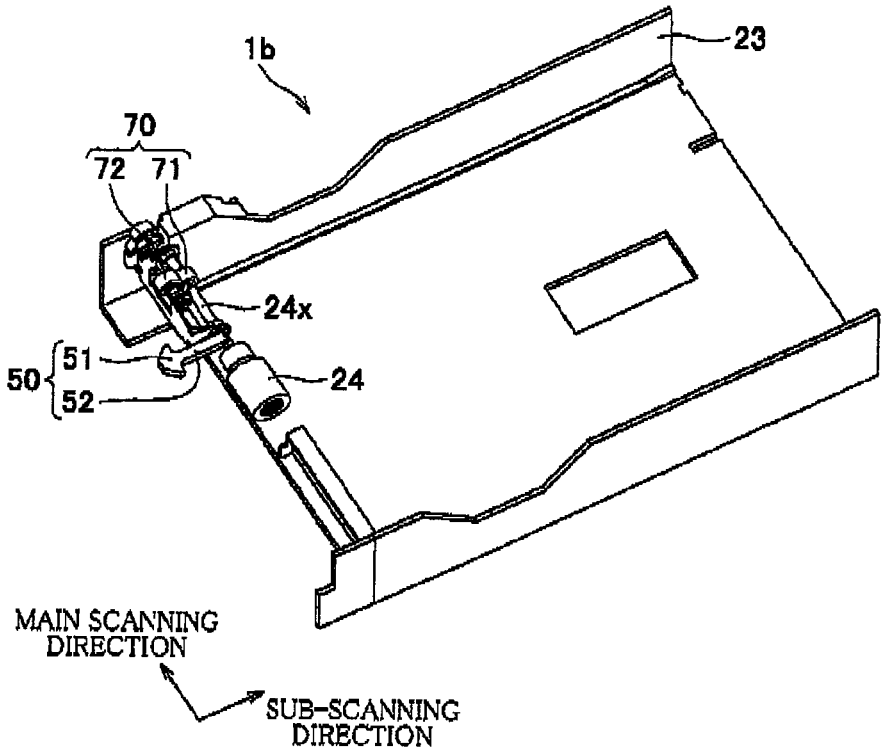
FIG. 4 is a perspective view showing a structure of the sheet-supply unit, with the cover omitted.

As shown in FIG. 4, the nip roller 24 is supported by the shaft 24*x* and is rotated about the shaft 24*x* together with the shaft 24*x*. The shaft 24*x* extends in the main scanning direction and has opposite ends in its longitudinal direction. The nip roller 24 is mounted on one of the opposite ends of the shaft 24*x*, and a first gear 71 is mounted on the other of the opposite ends of the shaft 24*x*. On the other end portion of the shaft 24*x* in the longitudinal direction, there is provided a driving portion 70 including the gear 71 and a second gear 72 connected to the gear 71. The printer 1 includes: a gear, not shown, connected to the gear 72; and a motor, not shown, for driving the gear. When the gear is driven by the motor on the basis of the control of the controller in the supply-unit mounted state, the gears 71, 72 connected to the gear are rotated, thereby rotating the nip roller 24 about the shaft 24*x* together with the shaft 24*x*.

Figure 5A:
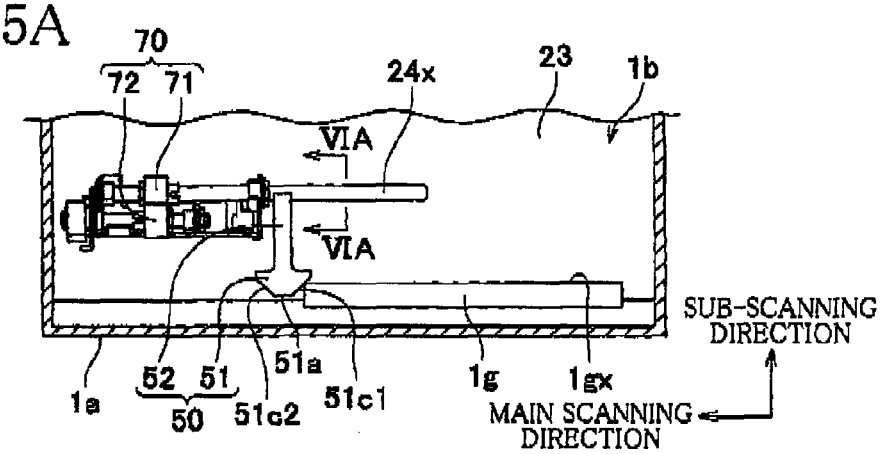
FIGS. 5A, 5B, and 5C are plan views generally showing a process in which the sheet-supply unit is removed from the casing.
Figure 5B:
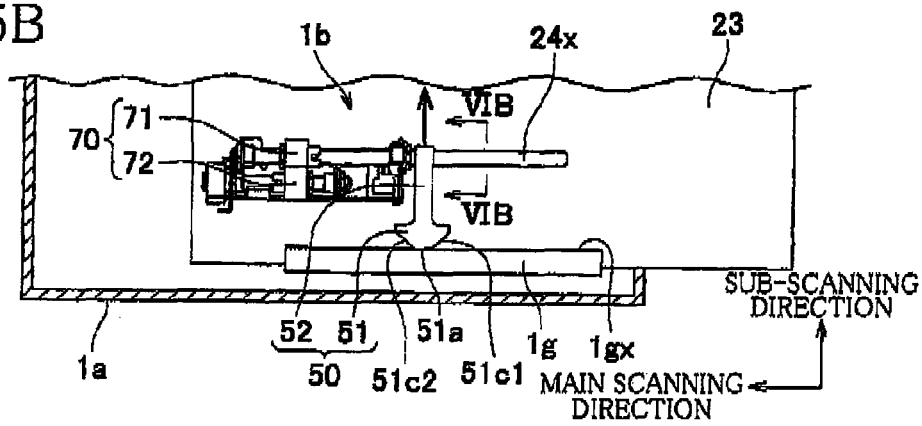
Figure 5C:
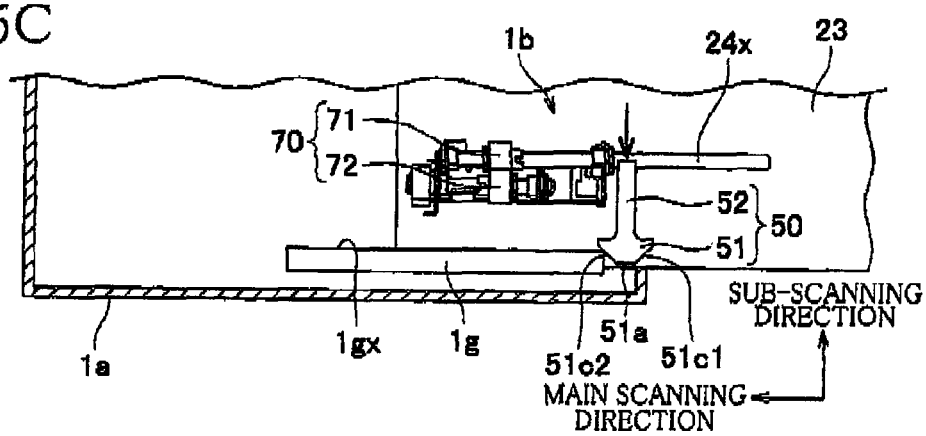
Figure 6A:
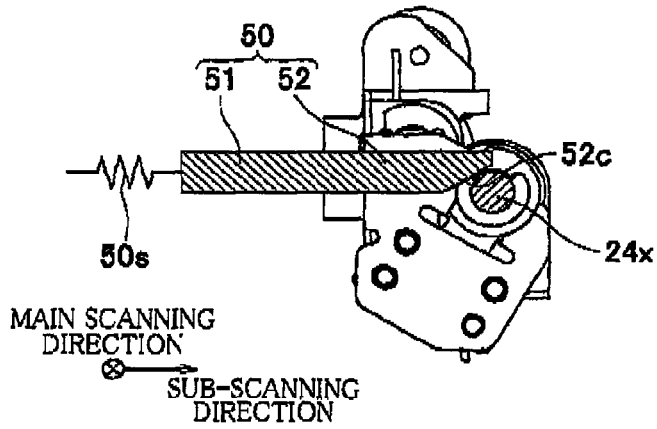
FIG. 6A is a partial cross-sectional view taken along a line VIA-VIA in FIG. 5A.
Figure 6B:
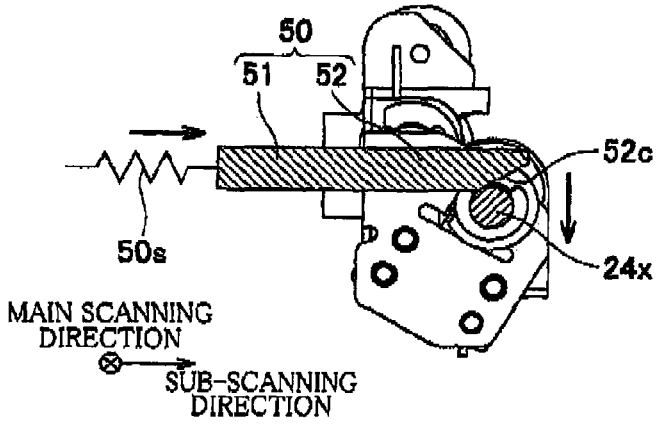
FIG. 6B is a partial cross-sectional view taken along a line VIB-VIB in FIG. 5B.

It is noted that the nip roller 24 is omitted in FIGS. 5, 6A, and 6B.

As shown in FIGS. 7A-7D, the nip roller 24 is urged or biased by a spring 24*s* (as one example of a force applying portion) in a direction toward the sheet-feed roller 25 (an upper right direction in FIGS. 7A-7D).

As shown in FIG. 4, a pressing portion 50 (as one example of a moving mechanism) is provided near the shaft 24*x*. The pressing portion 50 is a plate having an arrow shape in its whole shape and includes: a basal portion 51 having a generally triangular shape; and an extended portion 52 extending or projected in the sub-scanning direction from the basal portion 51. The extended portion 52 is located at a position generally the same in the main scanning direction as a position of a central portion of the shaft 24*x* in its longitudinal direction (i.e., a position between a portion of the shaft 24*x* on which the nip roller 24 is mounted and a portion of the shaft 24*x* on which the gear 71 is mounted).

As shown in FIGS. 6A and 6B, the pressing portion 50 is urged or biased by a spring 50*s* in a direction away from the shaft 24*x* in the sub-scanning direction (in a leftward direction in FIGS. 6A and 6B). The pressing portion 50 is supported by the side face 23*a* so as to be movable in the sub-scanning direction. As shown in FIG. 6B, when the sheet-supply unit 1*b* is mounted on or removed from the casing 1*a* (in mounting or removing the sheet-supply unit 1*b*), the pressing portion 50 moves in a direction toward the shaft 24*x* in the sub-scanning direction (in a rightward direction in FIGS. 6A and 6B) so as to press the shaft 24*x* downward. After the pressing portion 50 has pressed the shaft 24*x* for a specific length of time in mounting or removing the sheet-supply unit 1*b*, the pressing portion 50 is moved in the direction away from the shaft 24*x* in the sub-scanning direction by an urging force of the spring 50*s* and is returned to an original position (state) shown in FIG. 6A. As a result, the above-described pressing is released, that is, the pressing portion 50 stops pressing the shaft 24*x*. In accordance with this movement of the pressing portion 50, the shaft 24*x* is swung upward or downward with the other end of the shaft 24*x* in the longitudinal direction (a left rear end portion thereof in FIG. 4) being as a support point, whereby the nip roller 24 supported by the one end of the shaft 24*x* in its longitudinal direction is moved upward or downward.

As shown in FIGS. 6A and 6B, an inclined portion 52*c* (as one example of a contact face) is provided on a bottom face of a distal end portion of the extended portion 52 in a direction in which the extended portion 52 extends. The inclined portion 52*c* is inclined upward toward the distal end of the extended portion 52 with respect to the horizontal plane. As shown in FIGS. 5A-5C, inclined portions 51*c*1, 51*c*2 are provided on respective side faces of the basal portion 51 in the main scanning direction. When seen in a vertical direction, the inclined portions 51*c*1, 51*c*2 are inclined toward a center (in the main scanning direction) of the basal portion 51 in the direction away from the shaft 24*x* along the sub-scanning direction.

It is noted that, as shown in FIG. 3, components except the nip roller 24 (including the spring 24*s*, the shaft 24*x*, the pressing portion 50, the driving portion 70, and so on) are covered by the side face 23*a* and the cover 60 located at the closed position.

Here, there will be explained operations of components of the sheet-supply unit 1*b* in three states, namely, in the supply-unit mounted state, in mounting or removing the sheet-supply unit 1*b* as one example of a mounting and removing operation (hereinafter referred to as a "mounting and removing state"), and in a state (position) in which the sheet-supply unit 1*b* has been removed from the casing 1*a* (hereinafter may be referred to as a "supply-unit removed state").

Figure 7A:
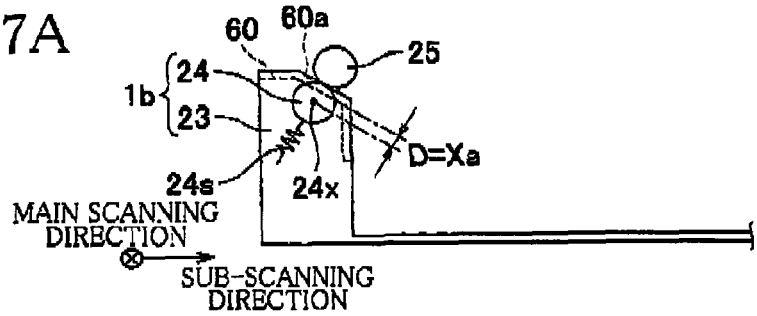
FIGS. 7A through 7D are side views generally showing positions of a nip roller at respective stages.
Figure 7B:
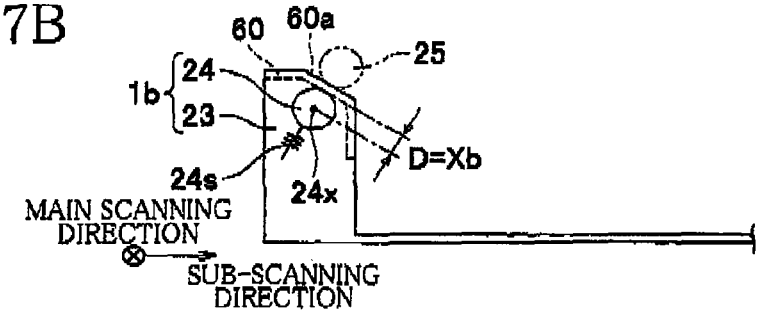

FIG. 5A shows the supply-unit mounted state, and FIGS. 5B and 5C show a state in which the sheet-supply unit 1*b* is being mounted or removed. States shown in FIGS. 7A, 7B, and 7C respectively correspond to the states shown in FIGS. 5A, 5B, and 5C. FIG. 7D shows a state in which the cover 60 has been moved to the open position in the supply-unit removed state. The cover 60 is kept at the closed position in the supply-unit mounted state and in the mounting and removing state. As shown in FIG. 7D, in the supply-unit removed state, the cover 60 is movable to the open position by a manual operation of the user. It is noted that the term "the mounting and removing state" includes the operation of the insertion of the sheet-supply unit 1*b* into the casing 1*a* and the operation of the removal of the sheet-supply unit 1*b* from the casing 1*a*. In other words, the mounting and removing operation is an operation in which the sheet-supply unit 1*b* is moving between a position corresponding to the supply-unit mounted state and a position corresponding to the supply-unit removed state.

As shown in FIGS. 5A and 6A, the pressing portion 50 is distant from the shaft 24*x* in the supply-unit mounted state. In this state, the nip roller 24 is located at a contact position (shown in FIG. 7A) at which the nip roller 24 is held in contact with the sheet-feed roller 25 while applying a pressing force to the sheet-feed roller 25 by an urging force of the spring 24*s*.

When the sheet-supply unit 1*b* is removed from the casing 1*a*, as shown in FIGS. 5A and 5B, the pressing portion 50 is moved in the direction toward the shaft 24*x* in the sub-scanning direction, whereby the inclined portion 52*c* presses the shaft 24*x* downward. In this operation, the inclined portion 51*c*1 is first brought into contact with a corner of one end (a left end in FIGS. 5A-5C) of a guide 1*g* (as one example of the moving mechanism and a support member) which is a plate member provided on the casing 1*a* so as to extend in the main scanning direction. Then, when the sheet-supply unit 1*b* has moved rightward in FIG. 5A, the inclined portion 51*c*1 is pressed by the one end of the guide 1*g*, thereby moving the pressing portion 50 upward in FIG. 5A. Then, when the sheet-supply unit 1*b* has been moved rightward in FIG. 5A, a flat face 51*a* of the basal portion 51 between the inclined portions 51*c*1, 51*c*2 is brought into contact with a guide face 1*gx* of the guide 1*g*. As a result, the pressing portion 50 takes a state shown in FIG. 6B. In this operation, the nip roller 24 is moved by a pressing force of the pressing portion 50 against the urging force of the spring 24*s* from the contact position (see FIG. 7A) to a distant position (see FIG. 7B) at which the nip roller 24 is distant from the sheet-feed roller 25.

As shown in FIG. 5B, the pressing portion 50 is then moved along the guide 1*g* in a state in which the flat face 51*a* is held in contact with the guide face 1*gx*. In this movement, the pressing portion 50 is kept in the state shown in FIG. 6B, and the nip roller 24 is kept at the distant position shown in FIG. 7B.

When the pressing portion 50 has reached the other end (a right end in FIGS. 5A-5C) of the guide 1*g*, the pressing portion 50 is moved in the direction away from the shaft 24*x* in the sub-scanning direction, thereby releasing the pressing on the shaft 24*x*, that is, the pressing portion 50 stops pressing the shaft 24*x*. In this operation, the inclined portion 51*c*2 is first brought into contact with a corner of the other end of the guide 1*g*. Then, when the sheet-supply unit 1*b* has moved rightward in FIG. 5C, the pressing portion 50 is moved downward in FIG. 5C such that the inclined portion 51*c*2 is brought into contact with the other end of the guide 1*g*. As a result, the pressing portion 50 is returned to the original position (state) shown in FIG. 6A by the urging force of the spring 50*s*. In this operation, the nip roller 24 is moved by the urging force of the spring 24*s* from the distant position (see FIG. 78) to a first projecting position (see FIG. 7C) which is located on an upper right side of the contact position (see FIG. 7A). In this movement, the shaft 24*x* is held in contact with an inner face of a contact portion 60*a* of the cover 60, thereby positioning the nip roller 24 against the urging force of the spring 24*s*. In other words, the position of the nip roller 24 is limited or restricted.

Then, when the sheet-supply unit 1*b* has been pulled or moved rightward from a position (state) shown in FIG. 5C so as to be distant from the casing 1*a*, the sheet-supply unit 1*b* takes the supply-unit removed state. It is noted that, when the sheet-supply unit 1*b* is inserted into the casing 1*a*, the components take the states respectively shown in FIGS. 5C, 5B, and 5A in order. The pressing portion 50 is kept at the original position (state) shown in FIG. 6A from a point in time when the pressing portion 50 has taken the state shown in FIG. 5C to a point in time when the sheet-supply unit 1*b* is mounted again on the casing 1*a* afterwards. Where the cover 60 is located at the closed position, the nip roller 24 is kept at the first projecting position (see FIG. 7C) from a point in time when the nip roller 24 has taken the state shown in FIG. 5C to the point in time when the sheet-supply unit 1*b* is mounted again on the casing 1*a* afterwards.

Then, when the cover 60 is moved from the closed position to the open position in the supply-unit removed state, the nip roller 24 is moved by the urging force of the spring 24*s* from the first projecting position (see FIG. 7C) to a second projecting position (see FIG. 7D) located on an upper right side of the first projecting position. That is, the positioning (i.e., the limitation or restriction of the positioning) of the nip roller 24 by the pressing of the inner face of the contact portion 60*a* on the shaft 24*x* is released. In other words, the nip roller 24 is not positioned by the pressing of the inner face of the contact portion 60*a*. In this state, the user can remove the nip roller 24 from the shaft 24*x* to replace the nip roller 24 with new one.

Figure 7C:
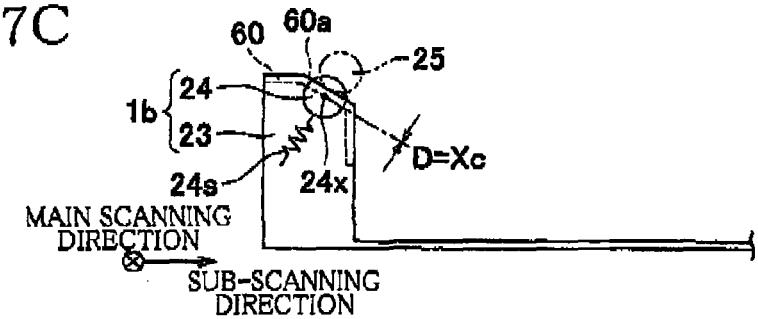
Figure 7D:
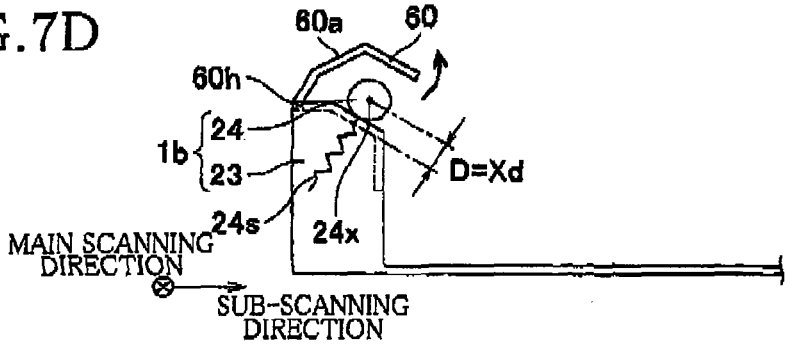

After the replacement of the nip roller 24, when the cover 60 has been moved from the open position to the closed position, the nip roller 24 is moved from the second projecting position (see FIG. 7D) to the first projecting position (see FIG. 7C). Then, when the sheet-supply unit 1*b* is mounted on the casing 1*a*, the above described stages appear in reverse order. That is, as shown in FIG. 5C, the inclined portion 51*c*2 is first brought into contact with the corner of the other end of the guide 1*g*, and then the pressing portion 50 is moved in the direction toward the shaft 24*x* in the sub-scanning direction so as to press the shaft 24*x* downward. As a result, the nip roller 24 is moved to the distant position (see FIG. 7B). Then, when the sheet-supply unit 1*b* has been inserted into the casing 1*a* and reached the position shown in FIG. 5A, the pressing portion 50 is moved by the urging force of the spring 50*s* so as to be moved in the direction away from the shaft 24*x* in the sub-scanning direction. As a result, the nip roller 24 is moved to the contact position (see FIG. 7A).

Here, there will be explained a distance D between a center of the shaft 24*x* and the inner face of the contact portion 60*a* of the cover 60 in each of the stages shown in FIGS. 7A-7D. The distance D is defined as "Xa," where the nip roller 24 is located at the contact position (see FIG. 7A), defined as "Xb" where the nip roller 24 is located at the distant position (see FIG. 7B), defined as "Xc" where the nip roller 24 is located at the first projecting position (see FIG. 7C), and defined as "Xd" where the nip roller 24 is located at the second projecting position (see FIG. 7D). Further, the distance D takes positive numbers where the center of the shaft 24*x* is located on an outer side of the inner face of the contact portion 60*a* and takes negative numbers where the center of the shaft 24*x* is located on an inner side of the inner face of the contact portion 60*a*. In this case, the distance D has the following relationship: Xd>Xc>Xa>Xb(Xc=0).

According to the printer 1 as the present embodiment, when the sheet-supply unit 1*b* is mounted on or removed from the casing 1*a*, the cooperative operation of the pressing portion 50 and the guide 1*g* moves the nip roller 24 in a direction away from the sheet-feed roller 25 to the distant position (see FIG. 7B). As a result, it is possible to prevent an occurrence of a friction between the rollers 24, 25, damage to the sheet P nipped by the rollers 24, 25, and the like. In the state in which the sheet-supply unit 1*b* has been removed from the casing 1*a*, the movements of the pressing portion 50 and so on are released. That is, though the nip roller 24 is being moved in the mounting and removing operation, the shaft 24*x* is not pressed by the pressing portion 50 in the supply-unit removed state, and thus the shaft 24*x* is not moved by the pressing portion 50. In this state, the nip roller 24 is located by the urging force of the spring 24*s* at a position nearer to the sheet-feed roller 25 than the distant position (see FIG. 7B), that is, the nip roller 24 is located at the first projecting position (see FIG. 7C) or the second projecting position (see FIG. 7D). Accordingly, it is easy for the user to replace the nip roller 24.

In this printer 1, the openable and closable cover 60 is provided, and in the state in which the sheet-supply unit 1*b* has been removed from the casing 1*a*, the user can easily replace the nip roller 24 by moving the cover 60 from the closed position to the open position to expose the area around the nip roller 24, for example. Further, where the cover 60 is positioned at the closed position, it is possible to prevent foreign materials from entering from the area near the nip roller 24. Further, where the cover 60 is located at the closed position, and the nip roller 24 is located at the distant position (see FIG. 7B) in the state in which the sheet-supply unit 1*b* has been removed from the casing 1*a*, foreign materials are more likely to enter from a space between the nip roller 24 and the cover 60 because the nip roller 24 is located at a relatively deep position. However, this printer 1 is configured such that the nip roller 24 is positioned at the first projecting position (see FIG. 7C) or the second projecting position (see FIG. 7D) located above the distant position in the sate in which the sheet-supply unit 1*b* has been removed from the casing 1*a*.

Accordingly, the space is made smaller, thereby preventing foreign materials from entering from the space.

When the cover 60 is moved from the closed position to the open position in the state in which the sheet-supply unit 1*b* has been removed from the casing 1*a*, the nip roller 24 is moved upward by the release of its positioning by the inner face of the contact portion 60*a*, whereby the nip roller 24 is disposed at the second projecting position (see FIG. 7D). As a result, it becomes easier for the user to replace the nip roller 24.

The guide 1*g* and the pressing portion 50 are used as the moving mechanism configured to move the nip roller 24 to the distant position when the sheet-supply unit 1*b* is mounted on or removed from the casing 1*a*. In this printer 1, the nip roller 24 can be moved by such a relatively simple construction.

In this printer 1, the nip roller 24 is the drive roller, and the gear 71 is mounted on the other end portion of the shaft 24*x* in its longitudinal direction. The pressing portion 50 presses a portion of the shaft 24*x* which is nearer to the one end in the longitudinal direction than the gear 71. As a result, the nip roller 24 can be moved while maintaining a connection state of the gears 71, 72 (i.e., without interfering with the driving of the driving portion 70).

In this printer 1, the inclined portions 51*c*1, 51*c*2 shown in FIGS. 5A-5C are provided on the opposite side faces of the pressing portion 50 in the main scanning direction (i.e., the faces pressed by the guide 1*g* respectively when the sheet-supply unit 1*b* is mounted on the casing 1*a* and when the sheet-supply unit 1*b* is removed from the casing 1*a*). The inclined portion 51*c*1 is the portion which is pressed by the one end of the guide 1*g* when the sheet-supply unit 1*b* is removed from the casing 1*a* (see FIG. 5A) and which is inclined, with respect to the plane perpendicular to the main scanning direction, toward a downstream side in the direction in which the sheet-supply unit 1*b* is moved with respect to the casing 1*a* in this removal (i.e., in a rightward direction in FIG. 5A), in the direction in which the pressing portion 50 is moved toward the shaft 24*x* (i.e., in an upward direction in FIG. 5A). The inclined portion 51*c*2 is the portion which is pressed by the other end of the guide 1*g* when the sheet-supply unit 1*b* is mounted on the casing 1*a* (see FIG. 5C) and which is inclined, with respect to the plane perpendicular to the main scanning direction, toward a downstream side in the direction in which the sheet-supply unit 1*b* is moved with respect to the casing 1*a* in this mount (i.e., in a leftward direction in FIG. 5C), in the direction in which the pressing portion 50 is moved toward the shaft 24*x* (i.e., in the upward direction in FIG. 5C). As a result, both in the case where the sheet-supply unit 1*b* is mounted on the casing 1*a* and in the case where the sheet-supply unit 1*b* is removed from the casing 1*a*, the pressing portion 50 is smoothly moved in the direction toward the shaft 24*x* in the state in which one of the inclined portions 51*c*1, 51*c*2 is held in contact with the guide 1*g*.

While the embodiment of the present invention has been described above, it is to be understood that the invention is not limited to the details of the illustrated embodiment, but may be embodied with various changes and modifications, which may occur to those skilled in the art, without departing from the spirit and scope of the invention.

One of a face of the guide which presses the pressing portion and a face of the pressing portion which is pressed by the guide needs only to be inclined in one of when the removable member is mounted on the casing and when the removable member is removed from the casing. For example, in the above-described embodiment, one of the inclined portions 51*c*1, 51*c*2 may be omitted. Further, instead of or in addition to the inclined portions 51*c*1, 51*c*2, an inclination may be formed on the one end and/or the other end of the guide 1*g*. Further, a curvature may be formed instead of the inclination, or neither of the inclination nor the curvature may be formed.

Various changes may be applied to a manner of the movement of the nip roller when the nip roller is moved in the direction away from the sheet-feed roller. For example, as one modification, the printer 1 may be configured such that a shaft of the gear 72 and the shaft 24*x* in the above-described embodiment are integrally fixed to each other, and the shaft 24*x* and the nip roller 24 are rotated about the shaft of the gear 72 to move the nip roller 24 upward and downward.

The nip roller is not limited to the retard roller. Further, the nip roller may not be the drive roller.

The pressing portion and the guide are one example of the moving mechanism in the above-described embodiment, but the moving mechanism is not limited thereto.

The cover may not position the nip roller. Further, the cover may be omitted.

The force applying portion is not limited to the spring, and another member may be used as long as the member can urge the nip roller.

The removable member is not limited to the sheet-supply unit. Examples of the removable member include (a) a sheet-feed unit provided on a downstream side of the above-described sheet-supply unit in the sheet feeding direction (e.g., a unit including the feed-roller pairs 28 and so on in the above-described embodiment), (b) a two-side recording sheet-feed unit disposed between the sheet-supply unit 1*b* and the sheet-feed unit 21 in the above-described embodiment and configured to: receive the sheet P that has been returned by being fed by the feed-roller pairs 28 in a direction reverse to the sheet feeding direction after the feeding of the sheet-feed unit 21; and feed the received sheet P to the sheet-feed unit 21 again in a state in which the sheet P has been turned upside down, and the like.

The recording apparatus to which the present invention is applied may include any number of the heads (as recording portions). Each head used in the recording apparatus to which the present invention is applied is not limited to the line head and may be a serial head. Each head is not limited to the above-described ink-jet head and may be a laser head. The heads are not necessary components in the recording apparatus to which the present invention is applied. For example, the recording apparatus may be mounted on another casing containing the heads.

The recording apparatus to which the present invention is applied is not limited to the printer. Examples of the recording apparatus include a facsimile machine, a copying machine, and the like.

What is claimed is:

1. A recording apparatus with a removable member, the recording apparatus comprising:

a casing configured to receive mounting of a feed roller rotatable to feed a recording medium;

the removable member insertable into and removable from the casing by being moved, relative to the casing in an axial direction of the feed roller, between (a) a removable-member mounted state in which the removable member is mounted on the casing and (b) a removable-member removed state in which the removable member has been removed from the casing, wherein a nip roller is mounted on the removable member via a shaft thereof extending in parallel with the axial direction of the feed roller, the nip roller being configured to nip the recording medium with the feed roller in feeding the recording medium in the state in which the removable member is in the removable-member mounted state;

a force applying portion configured to apply a force to the nip roller in a direction in which the nip roller is moved toward the feed roller; and a moving mechanism comprising a pressing portion configured to, when the removable member is moved relative to the casing in the axial direction of the feed roller, push and move the shaft of the nip roller such that the nip roller is moved to a first position, at which the nip roller is spaced apart from the feed roller, against the force of the force applying portion, wherein the nip roller is located at a second position in a state in which the shaft is not pushed by the pressing portion when the removable member is in the removable-member removed state, and wherein a height level relative to the removable member of the nip roller at the second position is higher than a height level relative to the removable member of the nip roller at the first position.

2. The recording apparatus according to claim 1, further comprising a cover provided on the removable member so as to be movable between (a) a closed position at which the cover covers an area around the nip roller and (b) an open position at which the area around the nip roller is exposed.

3. The recording apparatus according to claim 2, wherein, when in the closed position, the cover limits a position of the nip roller against the force of the force applying portion, and wherein, when in the open position, the cover releases the limitation of the position of the nip roller.

4. The recording apparatus according to claim 1, wherein the moving mechanism includes:

a support member provided on the casing so as to extend in the direction in which the removable member is moved;

wherein the pressing portion is configured to be pressed by the support member to press and move the shaft when the removable member is moved relative to the casing.

5. The recording apparatus according to claim 4, wherein the pressing portion extends in a first direction perpendicular to the direction in which the removable member is moved, and the pressing portion is configured to be pressed to move in the first direction in a mounting and removing operation.

6. The recording apparatus according to claim 5, wherein the pressing portion has a contact face formed on an end portion of the pressing portion, which end portion is opposite to an end portion thereof contactable with the support member, wherein the contact face is brought into contact with the shaft, and wherein, when the pressing portion has been moved in the perpendicular direction, the contact face is brought into contact with the shaft to move the nip roller.

7. The recording apparatus according to claim 4, wherein the shaft has opposite ends in a longitudinal direction thereof, wherein the nip roller is disposed on one end of the opposite ends of the shaft, and a first gear is disposed on another end of the opposite ends of the shaft, wherein the recording apparatus further comprises a driving portion including the first gear and a second gear connected to the first gear, the driving portion being configured to drive the second gear to rotate the nip roller together with the shaft, and wherein the pressing portion is configured to press a portion of the shaft, the portion of the shaft being nearer to the one end of the shaft than the first gear.

8. The recording apparatus according to claim 1, wherein the removable member has an accommodating portion configured to accommodate a plurality of recording media.

* * * * *